US007110499B2

(12) United States Patent
Beyerlein et al.

(10) Patent No.: US 7,110,499 B2
(45) Date of Patent: Sep. 19, 2006

(54) HIGH-VOLTAGE SUPPLY FOR AN X-RAY DEVICE

(75) Inventors: Walter Beyerlein, Bubenreuth (DE); Werner Kühnel, Uttenreuth (DE)

(73) Assignee: Siemens Aktiengesellschaft, (DE)

( * ) Notice: Subject to any disclaimer, the term of this patent is extended or adjusted under 35 U.S.C. 154(b) by 0 days.

(21) Appl. No.: 11/175,708

(22) Filed: Jul. 6, 2005

(65) Prior Publication Data

US 2006/0023841 A1 Feb. 2, 2006

Related U.S. Application Data

(63) Continuation of application No. PCT/EP2003/014257, filed on Dec. 15, 2003.

(51) Int. Cl.
*H05G 1/10* (2006.01)

(52) U.S. Cl. ..... 378/101; 378/104

(58) Field of Classification Search ..... 378/91, 378/101–118

See application file for complete search history.

(56) References Cited

U.S. PATENT DOCUMENTS

| | | | | |
|---|---|---|---|---|
| 5,008,912 | A * | 4/1991 | Farrall et al. | 378/91 |
| 5,093,853 | A * | 3/1992 | Licht et al. | 378/117 |
| 5,132,999 | A * | 7/1992 | Wirth | 378/101 |
| 5,159,697 | A * | 10/1992 | Wirth | 378/93 |
| 5,229,743 | A * | 7/1993 | Miscikowski et al. | 338/297 |
| 5,333,169 | A * | 7/1994 | Koertge | 378/109 |
| 5,363,286 | A * | 11/1994 | Tsuchiya | 363/8 |
| 5,894,502 | A * | 4/1999 | Beyerlein et al. | 378/101 |
| 5,923,723 | A * | 7/1999 | Herbst | 378/101 |
| 5,978,446 | A * | 11/1999 | Resnick | 378/105 |

FOREIGN PATENT DOCUMENTS

| | | |
|---|---|---|
| EP | 0 421 720 A | 4/1991 |
| EP | 0 497 517 A | 8/1992 |
| EP | 0 933 980 A | 8/1999 |

OTHER PUBLICATIONS

Translation of German Office Action, Jan. 20, 2006 from German priority Application No. DE 10300542.0-54.
PCT International Search Report PCT/EP 03/14257.

* cited by examiner

*Primary Examiner*—Edward J. Glick
*Assistant Examiner*—John M. Corbett
(74) *Attorney, Agent, or Firm*—James L. Katz; Brinks Hofer Gilson & Lione

(57) ABSTRACT

The disclosed, embodiments relate to a high-voltage supply (11, 13, 23) for an X-ray device. The X-ray device comprises an X-ray tube (15) and a high voltage generator(1), for generation of the high voltage necessary for operating the X-ray tube (15). The high voltage supply (11, 13, 23) comprises electrically-conducting lines (11, 13), for the connection of the high voltage generator to the X-ray tube (15). Each of the lines (11, 13) comprises one end which may be connected to the high voltage generator (1) and a further end which may be connected to the X-ray tube (15). At least one end of at least one of the lines (11, 13) may be connected to an electrical terminal resistor (39) which may be arranged between the line (11, 13) and the high voltage generator (1), or between the line (11, 13) and the X-ray tube (15).

20 Claims, 4 Drawing Sheets

HIGH-VOLTAGE SUPPLY FOR AN X-RAY DEVICE

REFERENCE TO RELATED APPLICATIONS

This application is related to and claims the benefit of priority as a continuation application under 35 U.S.C. §§ 120, 271 and 365 to Patent Cooperation Treaty patent application no. PCT/EP2003/014257, filed on Dec. 15, 2003, which was published at WO 2004/064458, in German.

This application is further related to and claims benefit of priority under 35 U.S.C. § 119 to the filing date of Jan. 9, 2003 of German patent application no. 10300542.0 DE, filed on Jan. 9, 2003.

BACKGROUND

X-ray tubes are typically constructed as high-vacuum tubes. Because of the high vacuum, sparkovers, and the resultant short circuit, between the cathode and the anode of the X-ray tube when the X-ray voltage, which is in the kilovolt range, is applied are fundamentally prevented. Slight quantities of residual gases, which contaminate the high vacuum, however, are unavoidable. This is true particularly because over the course of operation of the X-ray tube, gaseous ingredients of material emerge in the interior of the tube. The residual gases can be ionized by the X-ray voltage. The ionization may cause a sparkover and thus the short circuit inside the X-ray tube.

The courses over time of the short-circuit currents and the resultant events for charge compensation in the lines of the high-voltage supply sometimes have very steep flanks, since they proceed very quickly. The resultant interference spectrum therefore extends into the upper megahertz range and is extremely broadbanded. Moreover, the short-circuit currents and charge compensation currents cause vibrations associated with over-voltages, and these vibrations fade only very slowly.

Because of such interference signals and over-voltages in the high-voltage circuit of the X-ray device, problems in the function of the electronics and the computer system can occur. Often, component failures also occur, above all in the high-voltage circuit of the high voltage generator. Besides the downtimes in operation and expensive damage to the X-ray device, these problems also cause an increased radiation exposure to patients to be examined, who because of system failures must be examined repeatedly.

DETAILED DESCRIPTION OF THE DRAWINGS AND PRESENTLY PREFERRED EMBODIMENTS

The disclosed embodiments relate to a high-voltage supply for an X-ray device, which substantially comprises electrical lines that are disposed between a high-voltage circuit and an X-ray tube of the X-ray device.

An especially advantageous variant of this feature is obtained by providing that the unilateral terminal resistor is disposed on the X-ray tube side of each high-voltage line. As a result, it is possible to maintain the high output impedance of the high voltage generator that must be adhered to for the sake of good operation.

From European Patent Disclosure EP 0 497 517, an X-ray device is known in which one resistor that limits the electrical voltage is provided toward ground on each side of the X-ray tube. These resistors, however, cause power losses in the heating current for heating the cathode.

From German Patent Disclosure DE 24 02 125 and Japanese Patent Disclosure JP 54090987, X-ray devices are also known in which voltage-limiting components are provided, but without taking into account the cathode heating current.

According to the disclosed embodiments, an X-ray device in which interference signals and over-voltages, which occur because of short circuits in the X-ray tube, are damped so severely that functional problems of the electronics and component damage inside the X-ray device are avoided, and in which at the same time power losses of a cathode heating current are kept slight.

Fundamentally, in the disclosed embodiments, vibration and interference signals are damped in the high-voltage supply of the X-ray device, or in other words between the high voltage generator and the X-ray tube. The damping is accomplished by the provision of terminal resistors at the high-voltage lines of the high-voltage supply. Damping by means of terminal resistors is especially uncomplicated and simple to achieve. A heating current transformer is connected to the X-ray tube via additional filter inductors, which are disposed parallel to the terminal resistor on the cathode side.

One advantageous feature is attained if the high-voltage lines of the high-voltage supply are provided with a terminal resistor not on both ends but on only one end, or in other words unilaterally. Even a unilateral terminal resistor can in fact accomplish fast enough fading of the interference signals.

An especially advantageous variant of this feature is obtained by providing that the unilateral terminal resistor is disposed on the X-ray tube side of each high-voltage line. As a result, it is possible to maintain the high output impedance of the high voltage generator that may result in good operation.

In a further advantageous feature of the disclosed embodiments, the impedance of the terminal resistors is adapted to the line impedance of the particular line. Adequate damping is obtained in particular if the impedance of the terminal resistors is equivalent to the impedance of the high-voltage lines.

Figure 1:
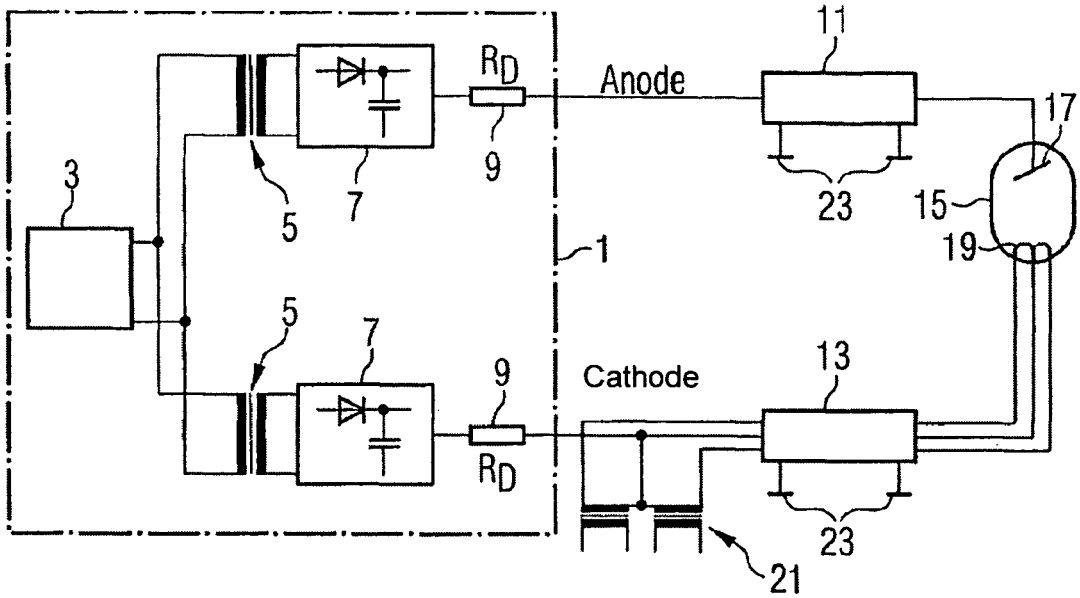
FIG 1 (Prior Art)
FIG. 1, the basic layout of the high-voltage circuit of an X-ray device of the prior art.

In FIG. 1, the basic layout of the high-voltage circuit of an X-ray device in the prior art is shown. Inside the X-ray generator 1, a primary voltage generator 3 generates a primary voltage which is carried on to high-voltage transformers 5 and transformed by them into a high voltage that is sufficient for operation of the X-ray tube. The high voltage output of the high-voltage transformers 5 is carried to the components 7, including a rectifier diode and a smoothing capacitor as shown in symbolic form and is rectified and smoothed by them. The components 7 output the smoothed high voltage to the damping resistors 9 (RD). The damping resistors 9 (RD) have the task of largely protecting the X-ray generator 1 against over-voltages and interference signals from the high-voltage supply. The values of the damping resistors 9 (RD) are implementation dependent but typically have values on the order of magnitude of a few kilo-ohms.

The X-ray tube 15 is connected to the high voltage generator 1 by a high-voltage supply located between them, where the high- voltage supply substantially includes an anodic coaxial high-voltage line 11 and a cathodic coaxial high-voltage line 13. The coaxial construction of the high-voltage lines 11 and 13 is represented in the drawing as a box instead of as a line. The anodic high-voltage line 11 connects the output of the high voltage generator 1 to the anode 17 of the X-ray tube 15. Analogously, the cathodic high-voltage line 13 connects the cathode 19 of the X-ray tube 15. The X-ray tube 15 can be embodied with two beams, that is, as a dual-focus tube, which is why the cathode 19 is shown with two coils in the drawing. The two coils of the cathode 19 are supplied with heating current by the heating transformer 21.

To reduce the problems caused in conjunction with short circuits that occur in the X-ray tube 15, it is known on the one hand to provide high-impedance damping resistors 9 (RD) in the kilo-ohm range on the high voltage generator 1, and on the other, to be careful to provide clean grounding of all the components in the entire high voltage generator, so as to assure unambiguous reference potentials and to avoid induction loops. Above all, "dragging" of the interference potentials should be avoided. The clean grounding of all the components is represented by the multiple grounding 23 of the coaxial high-voltage lines.

Figure 2:
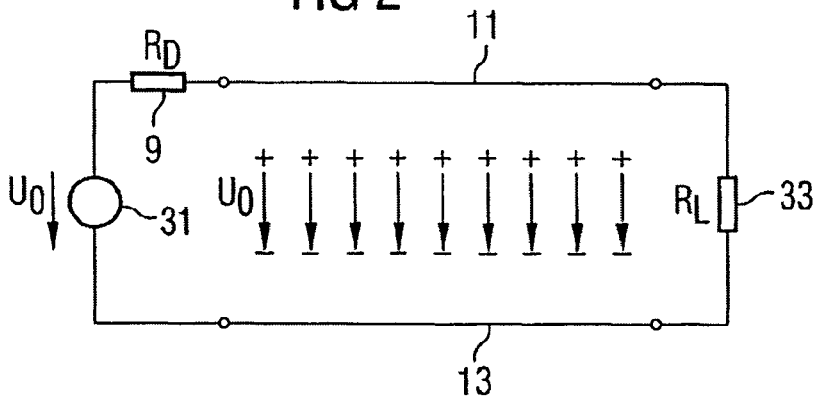
FIG 2 (Prior Art)
FIG. 2, voltage ratios in the high-voltage supply during operation of the X-ray device of FIG. 1.

FIG. 2 schematically shows the high-voltage circuit of an X-ray device of the prior art. By means of the generator 31, the X-ray voltage U0 is generated and is output via the damping resistors 9 (RD) to the high-voltage lines 11 and 13. Via the high-voltage lines 11 and 13, the voltage is applied to the X-ray tube, which is shown here as a load resistor 33 (RL). The high-voltage circuit is shown during operation, that is, in the steady state. The anodic high-voltage line 11, over its entire length, is at potential U0, and the cathodic high-voltage line 13 over its entire length is at −U0 volts. For the sake of clarity, in FIG. 3 and below, only the anodic side will be considered while the cathodic side will be ignored. The potential distribution on the anodic high-voltage lines is represented in FIG. 2 by arrows, which are marked with pluses, minuses, and U0. The potential drop in the damping resistors 9 (RD) will be ignored.

Figure 3:
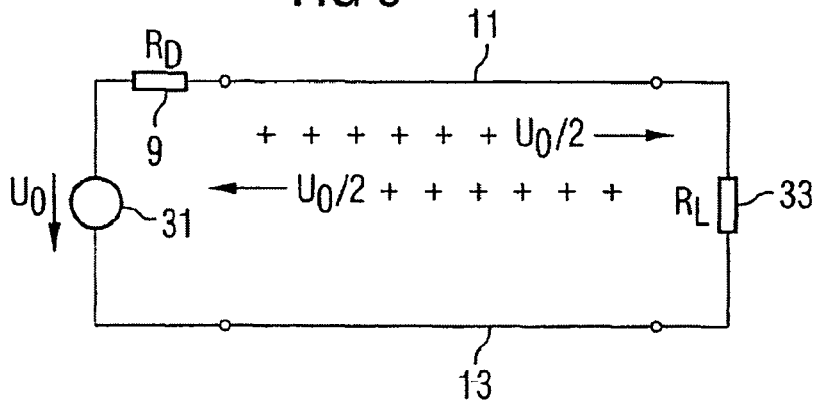
FIG 3 (Prior Art)
FIG. 3, voltage ratios in the high-voltage supply immediately after the occurrence of a short circuit in the X-ray tube of FIG. 1.

FIG. 3 shows the same schematic illustration of the high-voltage circuit of the prior art as FIG. 2, with the same reference numerals. However, FIG. 3 shows the high-voltage circuit at a different time, namely immediately after the occurrence of a short circuit in the X-ray tube.

The occurrence of a short circuit in the X-ray tube thus means the same as saying that the load resistance 33 (RL) vanishes; that is, RL=0. As a consequence of the vanishing of the load resistance 33 (RL), the voltage at the high-voltage lines 11 and 13 collapses, because the charges that are located on the high-voltage lines 11 and 13 can flow out via the short circuit in the X-ray tube. This type of discharge of an equally charged line is a standard problem that is very well known in the literature. The discharge process can be described in approximate terms by saying that half of the charges move to the left on the line and the other half of the charges move to the right. As a result, waves with half the output voltage (that is, U0/2) move to the left and right away from one another on each line. This is indicated in FIG. 3 only for the anodic high-voltage line 11 by means of arrows that are marked + and U0/2 and that are oriented to the right and left, respectively, along the high-voltage line 11. The arrows are meant to symbolize the flowing away of the charges.

In the high-voltage circuit, the waves moving apart from one another strike impedance discontinuities to both the left and the right. On the left, these are the damping resistors 9 (RD), and on the right they are the short circuit in the X-ray tube, that is, the load resistance 33 (RL), which has assumed the value RL=0. The discontinuities in impedance reflect the waves proceeding away from one another, and a short circuit results in a reflection factor r=−1. Waves reflected at a short circuit are therefore known to change their sign; that is, in the present case, they change their voltage from +U0/2 to −U0/2. The reflected waves then converge again and meet and then run apart once again until they are reflected again from the discontinuities in the line impedance. For the waves traveling back and forth, an oscillation duration results that is dependent on the length of each of the high-voltage lines 11 and 13. After one-quarter of this oscillation duration, the high-voltage line assumes the voltage 0 over its entire length; after half the oscillation duration, it assumes the voltage −U0, and after three-quarters of the oscillation duration, it resumes the voltage of 0 again, until the oscillation process begins to repeat after one entire oscillation duration. The oscillation continues infinitely in principle, but in reality is damped by line losses.

For the sake of simplicity, the process has been described for only the anodic high-voltage line 11, but the processes on the cathodic high-voltage line 13 proceed fundamentally analogously, with the opposite sign.

As a result, on the high-voltage lines 11 and 13, an oscillation is obtained in which no over-voltages occur on the applicable line itself, but the line alternatingly assumes the voltages +U0 and −U0. At the damping resistors 9 (RD), twice the voltage therefore occurs in the course of the oscillation, or in other words 2U0. For a length of the high-voltage lines of 12 m, for instance, an oscillation duration of 266 nanoseconds results, that is, a frequency on the order of magnitude of a few megahertz. This oscillation, which can be conceived of as an interference signal, and the over-voltages that occur with it, can cause component failures and disruptions in operation in the X-ray device.

Figure 4:
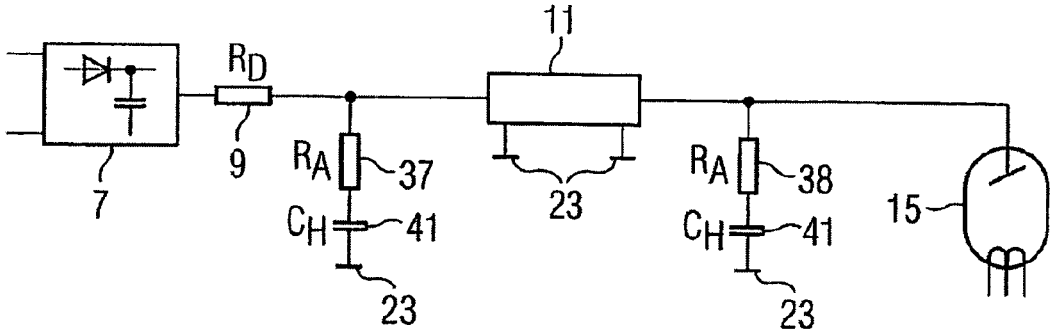
FIG. 4, a high-voltage line with parallel terminal resistors according to one embodiment.

FIG. 4 shows the anodic side of a high-voltage circuit of an X-ray device, according to one embodiment, with a rectifying and damping component 7, a damping resistor 9 (RD), coaxial high-voltage lines 11 that are grounded via the grounds 23, and an X-ray tube 15. This conventional construction is supplemented with the terminal resistor 37 (RA), which terminates the end toward the high voltage generator of the high-voltage line 11, and by the terminal resistor 38 (RA) that terminates the end toward the X-ray tube of the high-voltage line 11. The terminal resistors 37, 38 (RA) are connected in parallel; that is, they are located between the respective end of the high-voltage line 11 and the ground 23. They may be connected by soldering or other means. For the line impedance of the high-voltage lines 11, 13 in the high-voltage circuit of an X-ray device, value are implementation dependent but values of approximately 40 to 50 ohms are typical. The terminal resistors 39 (RA) therefore have a value of approximately 45 ohms, since their damping action becomes optimal when their impedance is equivalent to that of the high-voltage lines 11, 13.

In reality, however, the terminal by itself, with parallel terminal resistors 37, 38 (RA), would not be usable, since in the operating state, the entire operating voltage would be present at both terminal resistors 37 (RA) and 38 (RA) and would drop off toward ground, which would lead to permanent and extremely high power losses. Moreover, the terminal resistor 38 (RA) toward the X-ray tube would be short-circuited by the short circuit in the X-ray tube 15 and hence would be unable to build up any damping action.

Therefore to supplement the terminal resistors 37, 38 (RA), high-voltage smoothing capacitors 41 (CH) are provided, which are connected in series between these resistors and the ground 23. The high-voltage smoothing capacitors 41 (CH) have the task of allowing high-frequency interference signals and over-voltages to pass to the ground 23, but to block low-frequency and direct-voltage useful signals. They accordingly serve as a high-pass filter, whose frequency is to be selected such that interference signals can flow away to the ground, but with regard to useful signals, no lost power occurs. The high-voltage smoothing capacitors 41 (CH) moreover prevent the terminal resistor 38 (RA) toward the X-ray tube from being short-circuited by the short circuit in the X-ray tube 15 and therefore remaining ineffective. Because of the high frequencies of the interference signals, a high-pass filter with a relatively high limit frequency is required; a capacitance of the high-voltage smoothing capacitors 41 (CH) on the order of magnitude of approximately 50 nano-farads is therefore selected. Ceramic or foil capacitors, such that, for example, can be connected by soldering, may be employed.

Figure 5:
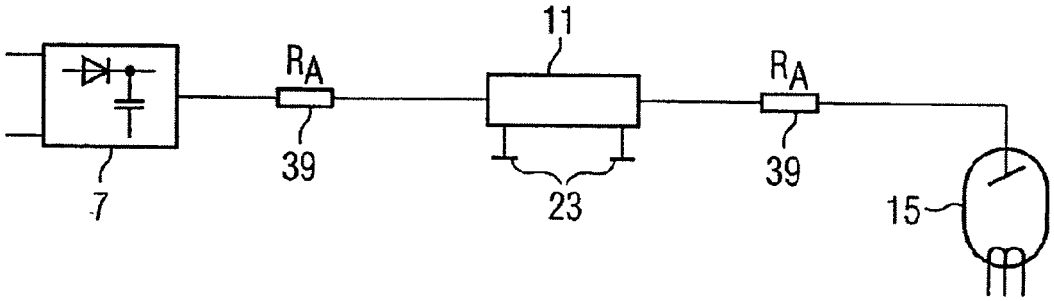
FIG. 5, a high-voltage line with serial terminal resistors according to one embodiment.

FIG. 5 shows an alternate embodiment, in a departure from the parallel connection of the terminal resistors. What is shown is the rectifying and damping component 7, the coaxial high-voltage line 11 with grounds 23, and the X-ray tube 15. Also shown are the terminal resistors 39 (RA), but this time in a series circuit between the high-voltage line 11 and the component 7 and between the high-voltage line 11 and the X-ray tube 15. The low-impedance terminal resistor 39 (RA) toward the high voltage generator replaces the high-impedance damping resistor RD that would normally be provided and protects the component 7 as well as the other X-ray generator adjoining it from behind, but not shown in FIG. 5, from over-voltages.

Since the damping resistor RD that is normally to be provided is on the order of magnitude of a plurality of kilo-ohms, the terminal resistor 39 (RA), which is on the order of magnitude of a few tens of ohms, does not offer the same protection against over-voltages in the high voltage generator 1. Hence the high voltage generator 1 would have to be dimensioned in a sufficiently sturdy manner so as to be able to withstand currents in the kilo-ampere range in the event of a short circuit in the X-ray tube 15.

In a modified variant of the circuit of FIG. 5, the terminal resistors 39 (RA) do not have the same impedance as the high-voltage lines 11, 13 to be terminated, but instead have twice the impedance or more, that is, at least 90 ohms. As a result of this dimensioning, a largely aperiodic discharge of the high-voltage lines 11, 13 is brought about. The aperiodic discharge proceeds in stages and requires a longer time than the discharge by terminal resistors 39 (RA) having the optimal impedance of 45 ohms. However, the higher dimensioning of the terminal resistors 39 (RA) has the advantage that the short-circuit current toward the X-ray tube is more severely limited. A disadvantage is the greater long-term lost line which is caused by the drop in the high voltage across the terminal resistors 39 (RA). In the operation of a thus-equipped X-ray device, it must also be noted that the X-ray tube voltage measured on the side toward the high voltage generator is measured wrong, by the amount of the increased voltage drop. However, this can be compensated for by a computational correction of the measured value.

Figure 6:
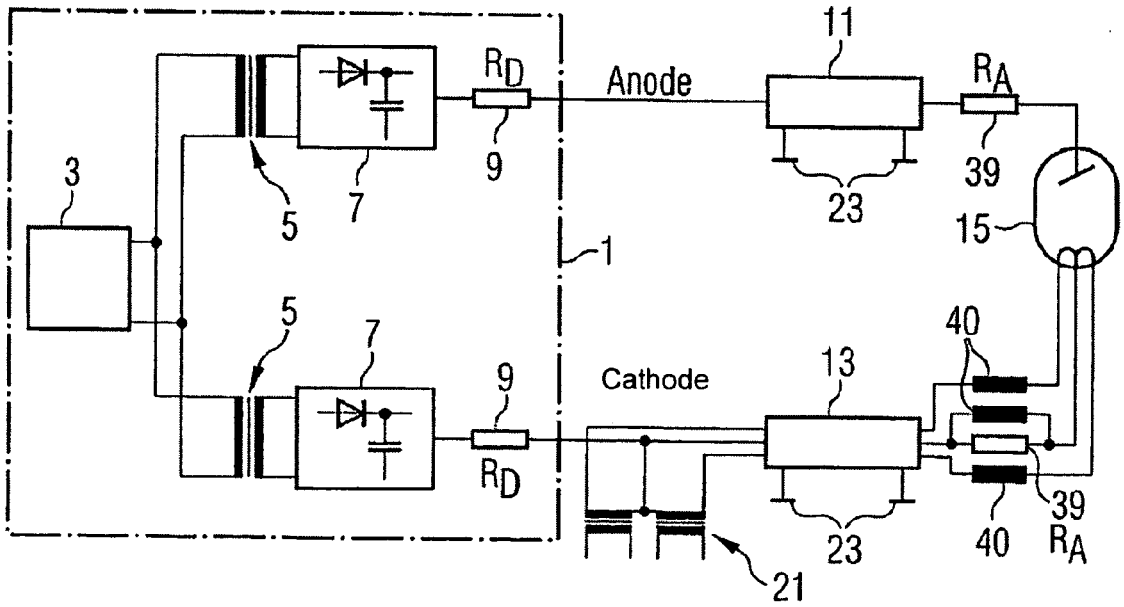
FIG. 6, a high-voltage circuit of an X-ray device with terminal resistors according to one embodiment and with filter inductors for the cathode heating current.

FIG. 6 shows a high-voltage circuit according to another embodiment, which is improved in terms of the aspects described. In it, a compromise has been made in terms of the terminal resistors in that here both the anodic high-voltage line 11 and the cathodic high-voltage line 13 are each terminated on only one side by a terminal resistor 39 (RA). The impedance of the terminal resistors 39 (RA) is approximately of equal magnitude to the line impedance of the high-voltage lines 11 and 13, or in other words is approximately 45 ohms. FIG. 6 shows the high voltage generator 1, and in it the primary voltage generator 3, the high-voltage transformers 5, the rectifying and damping components 7, the damping resistors 9 (RD), and the heating current transformer 21. The high voltage generator 1 is connected to the X-ray tube 15 via the coaxial high-voltage lines 11 and 13 that are connected to the ground 23. The terminal resistors 39 (RA) are disposed between the high-voltage lines 11 and 13 and the X-ray tube 15 in a series circuit. The only unilateral termination of the high-voltage lines 11 and 13 prevents the occurrence of a permanent oscillation upon the occurrence of a short circuit in the X-ray tube 15.

Of the two waves, moving apart from one another for charge compensation in the high-voltage lines 11 and 13 and having the voltages −UO/2 and −UO/2, respectively, only that wave that is running in the direction of the high voltage generator 1 is reflected, since an impedance discontinuity occurs only toward the generator. In the direction toward the X-ray tube 15 that is equipped with terminal resistors 39 (RA), the waves travel onward without being reflected, and the charges can flow away. The process of charge compensation therefore ends after reflection has occurred only once. The only unilateral termination of the high-voltage lines 11 and 13 thus offers fast enough fading of the interference signals and hence adequate damping of over-voltages.

On the cathodic high-voltage side, the special feature occurs that the cathode is supplied with not only the negative part of the X-ray tube voltage but also with the heating current for the cathode. In a conventional dual-focus tube, there are accordingly a total of three lines, which supply the two cathode coils with heating current and with the cathodic X-ray voltage. If a terminal resistor were to be inserted into the heating current supply as well, then unjustifiably heavy losses in the heating current—which still amounts to several amperes—would be the result. Since the three terminal resistors would be connected parallel to one another on the lines, they would furthermore have to have three times higher a resistance than the single terminal resistor 39 (RA), and the heating current losses would therefore even triple.

In order nevertheless to protect the heating current transformer 21 against over-voltages and interference signals in the event of a short circuit in the X-ray tube 15, additional filter inductors 40 are therefore introduced, instead of terminal resistors. These additional filter inductors 40 are embodied as current-compensated chokes and as a rule are joined together by soldering, or other suitable means. They have the task of blocking the high-frequency interference signals in the high-voltage line 13 but conversely allowing the low-frequency heating current to pass through. In that sense they represent a low-pass filter. For that purpose, they are disposed in a series circuit between the X-ray tube 15 and the high-voltage line 13 and the heating current transformer 21 and in a parallel circuit to the terminal resistor 39 (RA). The size of the filter inductors 40 should be determined as a function of the interference signals in the high-voltage line 13 or 11, as applicable. Since the interference signals vary in the megahertz range and the heating current typically varies in the kilohertz range, the filter inductors 40 should have a size of approximately 50 microhenrys.

In an improved embodiment of this circuit, it would be possible for the filter inductors 40 on the cathodic high-voltage side to be embodied as current-compensated chokes, in order to further reduce the total inductance compared to the heating current, without reducing the filter efficiency with respect to the high-frequency interference signals.

Figure 7:
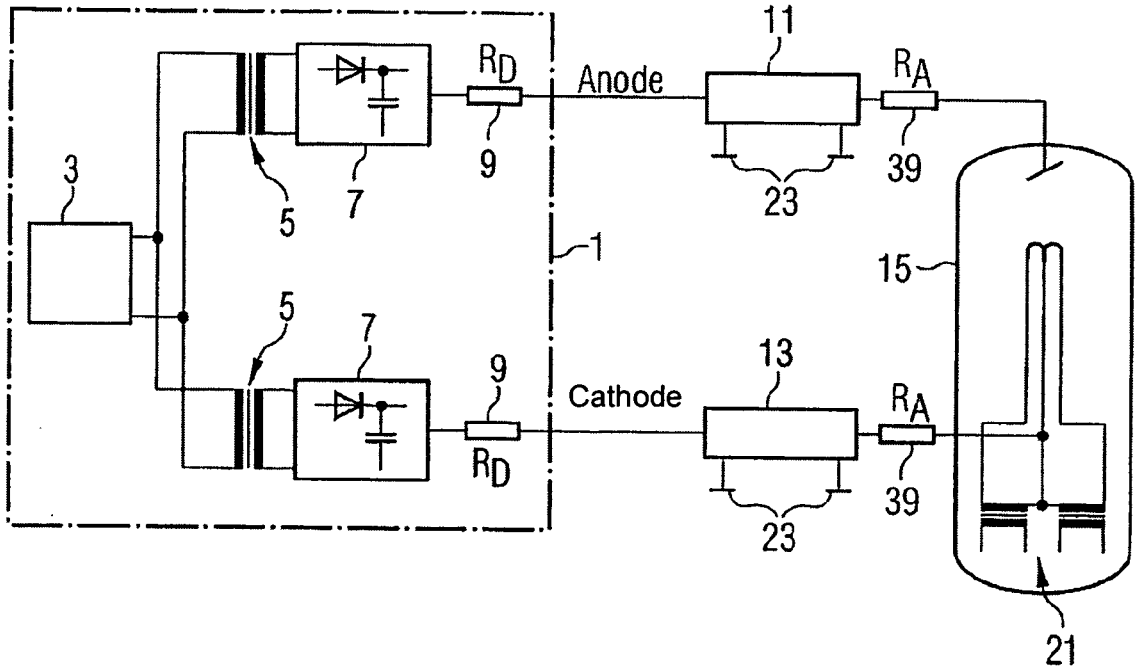
FIG. 7, a high-voltage circuit of an X-ray device according to an alternate embodiment, with a heating current transformer integrated into the X-ray tube.

FIG. 7 shows another alternate embodiment, which is altered substantially with regard to the supply of heating current to the cathode. FIG. 7 shows the high-voltage circuit with the high voltage generator 1 and with the internal component units already known from the previous figures. The anodic high-voltage line 11 and the cathodic high-voltage line 13 are connected in the high voltage generator 1, and these lines are in turn connected in a series circuit to the terminal resistors 39 (RA). In the conventional layout, shown thus far, of the high voltage generator, the heating current transformer 21 is located in the periphery of the X-ray tube 15, approximately in the high voltage generator 1 or inside the high-voltage tank that surrounds the X-ray tube 15 in order to protect the environment from high voltage and radiation. In contrast to this conventional layout, the heating current transformer 21 in FIG. 7 is located inside the X-ray tube 15. As a result, the heating current transformer 21 is decoupled from the very outset from the interference events in the high-voltage line 13. No additional filter inductors for filtering over-voltages or interference signals therefore have to be disposed upstream of the heating current supply.

It is clear that the implementation of this embodiment necessitates a change in the layout of the entire high voltage generator. Conversely, such changes as supplementing terminal resistors and additional filter inductors can be made at considerably less expense.

Figure 8:
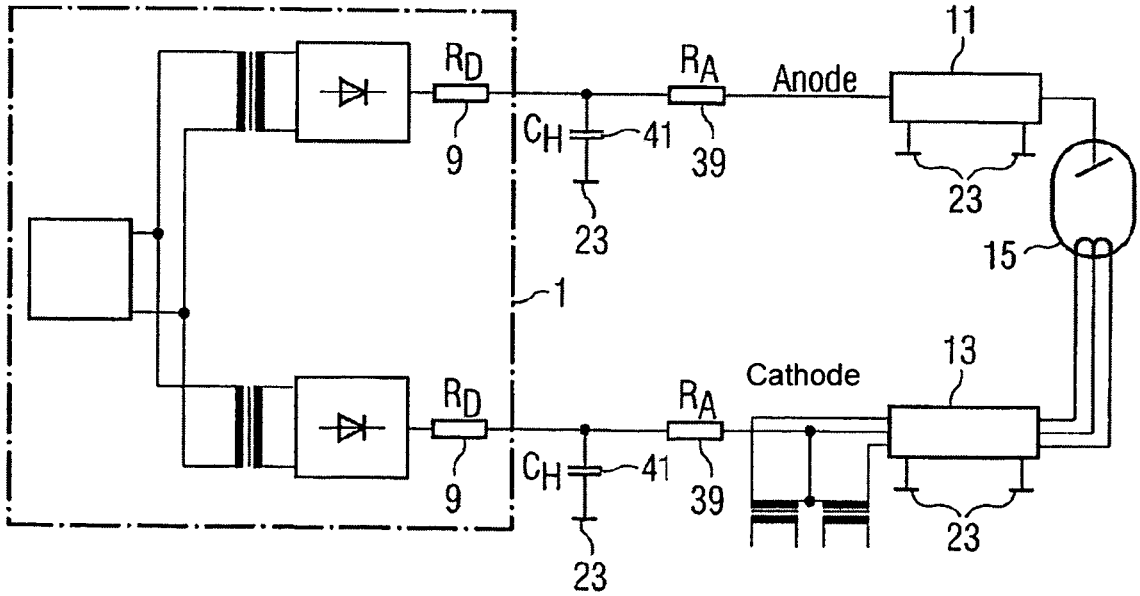
FIG. 8, a high-voltage circuit of an X-ray device according to an alternate embodiment, with high-voltage smoothing capacitors at the outputs of the high voltage generator.

FIG. 8 shows a further variant of the high-voltage circuit, in which the high-voltage lines 11 and 13 are again each provided on one end with terminal resistors 39 (RA). FIG. 8 shows the high voltage generator 1 with the damping resistors 9 (RD) and otherwise with the same elements as in the previous figures. Both on the anodic and on the cathodic side, the terminal resistors 39 (RA) are connected to the X-ray generator 1, and in turn the coaxial high-voltage lines 11 and 13 are connected by them to respective grounds 23. The terminal resistors 39 (RA) are connected in series between the high-voltage lines 11 and 13 and the high voltage generator 1. In the high voltage generator 1, damping resistors 9 (RD), which are dimensioned with the usual order of magnitude of a few kilo-ohms, are also provided in the usual way. That is, the terminal resistors 39 (RA) are provided in addition to the damping resistors 9 (RD) inside the high voltage generator 1.

Between the terminal resistors 39 (RA) and the damping resistors 9 (RD) of the high voltage generator 1, high-voltage smoothing capacitors 41 (CH) are provided, as a rule ceramic or foil capacitors, which may be joined by soldering or other suitable means. The high-voltage smoothing capacitors 41 (CH) are connected to the respective connecting point between the damping resistors 9 (RD) and the terminal resistors 39 (RA) and to the respective ground 23. That is, they are connected parallel to the damping resistors 9 (RD) and parallel to the terminal resistors 39 (RA).

In this variant of the circuit, the high-voltage lines 11 and 13 are terminated with the series circuit of the respective terminal resistors 39 (RA) and the respective high-voltage smoothing capacitor 41 (CH). So that approximately only the ohmic resistance of the terminal resistors 39 (RA) will contribute to the line impedance, the high-voltage smoothing capacitors 41 (CH) must be selected as large enough to act with low impedance with regard to the compensation events in the high-voltage lines 11 and 13. With the requisite resistance for this purpose of approximately 50 nano-farads, this variant of the circuit is of interest particularly in the case of X-ray devices in whose high-voltage circuit, a large high-voltage smoothing capacitor is provided from the very outset.

Figure 9:
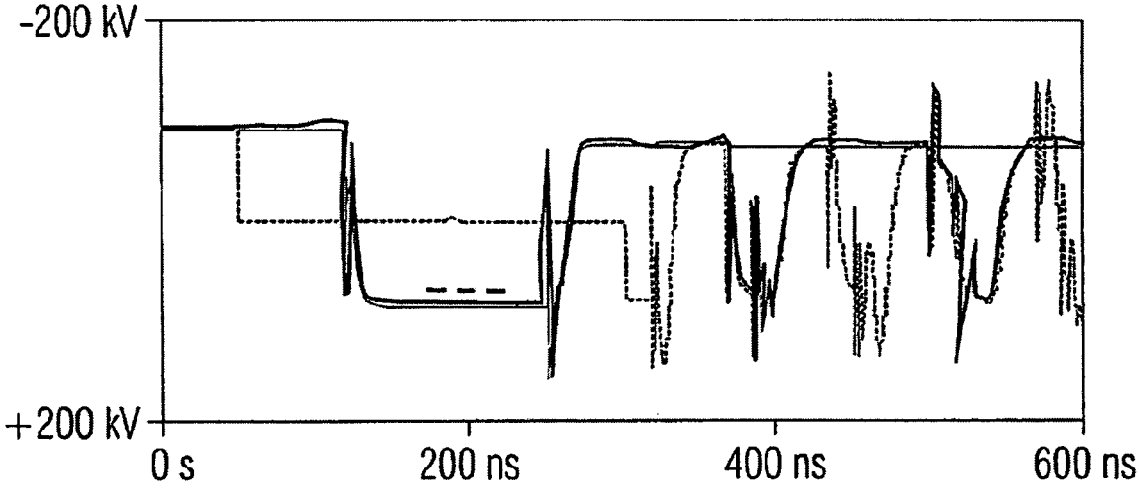
FIG 9 (Prior Art)
FIG. 9, a simulated voltage course at the cathode of an X-ray device in the prior art.

FIG. 9 shows a simulation of the voltage course of the cathode of a conventional high-voltage circuit of an X-ray device of the kind shown in FIG. 1. In FIG. 9, the cathodic high voltage is plotted over time, assuming a high voltage of 100 kilovolts, which is typical for radiology. At 50 nanoseconds, a short circuit in the X-ray tube is simulated; it is clearly apparent from the collapse of the cathodic voltage. The short circuit begins abruptly and ends equally abruptly at 300 nanoseconds. Two voltage courses are shown, of which one is tapped at the beginning of the high-voltage line 13 and the other at the end of the high-voltage line 13. Strong interference signals can be clearly seen, which after the end of the short circuit continue over a relatively long time and with marked over-voltage peaks. During the occurrence of these malfunctions, it would not be logically possible to operate the X-ray tube, or if the X-ray tube were in operation, component defects could occur.

Figure 10:
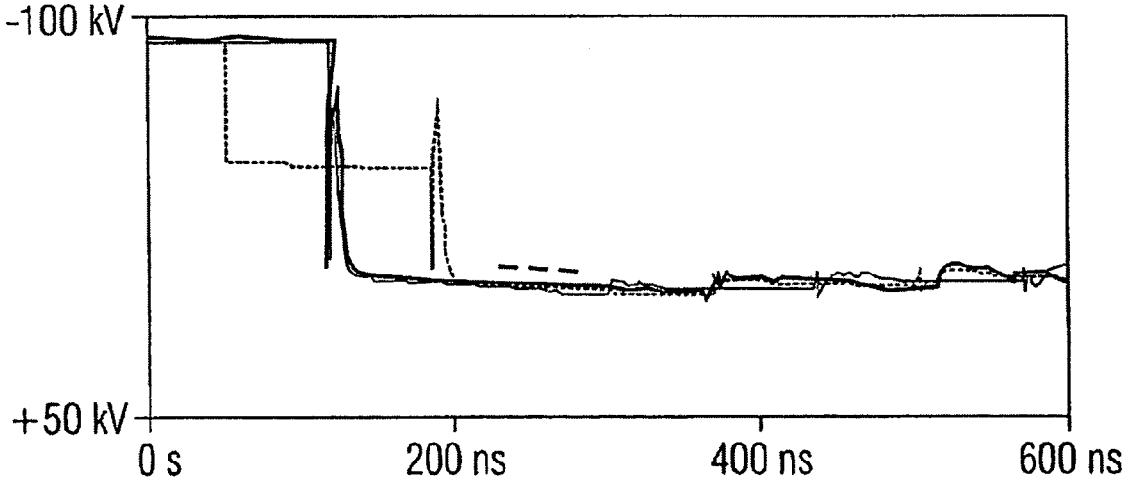
FIG. 10, a simulated voltage course at the cathode of an X-ray device according to one embodiment.

FIG. 10 shows the same simulation, based on a circuit according to the embodiment of the kind shown in FIG. 6. Once again, the cathodic voltage over time is shown. The two voltage courses again show the voltage at the beginning and end, respectively, of the high-voltage line 13. At 50 ns, a short circuit in the X-ray tube abruptly occurs, which at 300 ns ends equally abruptly. After the end of the short circuit, over-voltages and interference signals are entirely absent. Instead, the cathodic voltage, damped by the terminal resistor and the filter inductors, gradually rises again. After approximately 7 microseconds, an instant that is no longer shown in FIG. 10, the cathode reaches the operating voltage again.

With the introduction of terminal resistors, it is accordingly successfully possible to maximally protect the X-ray device against malfunctions and damage from the consequences of a short circuit in the X-ray tube. Only a brief time is needed until, after the end of a short circuit in the X-ray tube, the X-ray voltage is again reached, so that the operation of the X-ray device can then continue.

It is therefore intended that the foregoing detailed description be regarded as illustrative rather than limiting, and that it be understood that it is the following claims, including all equivalents, that are intended to define the spirit and scope of this invention.

We claim:

1. A high-voltage supply for an X-ray device, the X-ray device having an X-ray tube and a high voltage generator for generating the high voltage required for operating the X- ray tube, the high-voltage supply comprising:

a first electrically conductive line for connecting the high voltage generator to an anode of the X-ray tube, the first electrically conductive line including a first terminal resistor connected serially with the high voltage generator, anode and first electrically coupled line;

an electrically conductive set of lines for connecting the high voltage generator to a cathode of the X-ray tube, the electrically conductive set of lines including a second electrically conductive line having a first end connectable to the high voltage generator and a second end connectable to the cathode of the X-ray tube, the electrically conductive set of lines further comprising a plurality of electrically conductive lines coupling the cathode of the X-ray tube with a transformer for generating heating current for the cathode, each of the plurality of electrically conductive lines including a filter inductor connected in series with the associated line and the cathode; and wherein the second electrically conductive line comprises a second terminal resistor connected in series between the second end of the second electrically conductive line and the cathode in parallel with the filter inductor of each of the plurality of electrically conductive lines.

2. The high-voltage supply of claim 1, wherein the first electrically coupled line comprises a first end connectable to the high voltage generator and a second end connectable to the anode of the X-ray tube, and further wherein the first terminal resistor is disposed between the first end and the high voltage generator.

3. The high-voltage supply of claim 1, wherein the first electrically coupled line comprises a first end connectable to the high voltage generator and a second end connectable to the anode of the X-ray tube, and further wherein the first terminal resistor is disposed between the second end and the anode.

4. The high-voltage supply of claim 1, wherein the filter inductor is characterized by a magnitude of approximately 50 μH.

5. The high-voltage supply according to claim 1, wherein the first terminal resistor is connected in series between one of the line and the high voltage generator and the line and the anode of the X-ray tube.

6. The high-voltage supply according to claim 1 wherein the first a terminal resistor is characterized by an impedance approximately equal to the line impedance of the first electrically conductive line connected thereto.

7. The high-voltage supply according to claim 1 wherein the first and terminal resistor is characterized by an impedance at least twice as great as the line impedance of the first electrically conductive line connected thereto.

8. The high-voltage supply according to claim 1 wherein the second terminal resistor is characterized by an impedance approximately equal to the line impedance of the second electrically conductive line connected thereto.

9. The high-voltage supply according to claim 1 wherein the second terminal resistors is characterized by an impedance at least twice as great as the line impedance of the second electrically conductive line connected thereto.

10. The high-voltage supply according to claim 1, wherein the first and second terminal resistors each comprise a single terminal resistor.

11. The high-voltage supply according to claim 1, wherein the filter inductor of each of the plurality of electrically conductive lines comprises a current-compensated choke.

12. The high-voltage supply according to claim 1, further comprising a third terminal resistor connected between the first end of the first electrically conductive line and a high voltage smoothing capacitor further connected to ground.

13. The high-voltage supply according to claim 12, wherein the high-voltage smoothing capacitor is characterized by a capacitance of approximately 50 nF.

14. A method of supplying a high voltage from a high voltage generator to an X-ray tube, the method comprising:

connecting the high voltage generator to an anode of the X-ray tube via a first electrically conductive line including a terminal resistor coupled in series between the high voltage generator and the anode;

connecting the high voltage generator to a cathode of the X-ray tube via an electrically conductive set of lines, the electrically conductive set of lines including a second electrically conductive line and a plurality of electrically conductive lines, the second electrically conductive line having a first end connectable to the high voltage generator and a second end connectable to the cathode of the X-ray tube;

connecting the cathode of the X-ray tube with a transformer for generating heating current for the cathode via the plurality of electrically conductive lines, each of the plurality of electrically conductive lines including a filter inductor connected in series with the associated of the plurality of electrically conductive lines and the cathode; and providing a second terminal resistor connected in series between the second end of the second electrically conductive line and the cathode in parallel with the filter inductor of each of the plurality of electrically conductive lines.

15. The method of claim 14, wherein the first electrically coupled line comprises a first end connectable to the high voltage generator and a second end connectable to the anode of the X-ray tube, and further wherein the first terminal resistor is disposed between one of the first end and the high voltage generator or the second end and the anode.

16. The method of claim 14, wherein the first a terminal resistor is characterized by an impedance approximately equal to the line impedance of the first electrically conductive line connected thereto and the second terminal resistor is characterized by an impedance approximately equal to the line impedance of the second electrically conductive line connected thereto.

17. The method of claim 14, wherein the first and terminal resistor is characterized by an impedance at least twice as great as the line impedance of the first electrically conductive line connected thereto and the second terminal resistors is characterized by an impedance at least twice as great as the line impedance of the second electrically conductive line connected thereto.

18. The method of claim 14, further comprising providing a third terminal resistor connected between the first end of the first electrically conductive line and a high voltage smoothing capacitor further connected to ground.

19. The method of claim 18, wherein the high-voltage smoothing capacitor is characterized by a capacitance of approximately 50 nF.

20. A high-voltage supply for an X-ray device, the X-ray device having an X-ray tube and a high voltage generator for generating the high voltage required for operating the X-ray tube, the high-voltage supply comprising:

means for connecting the high voltage generator to an anode of the X-ray tube via a first electrically conductive line including a terminal resistor coupled in series between the high voltage generator and the anode;

means for connecting the high voltage generator to a cathode of the X-ray tube via an electrically conductive set of lines, the electrically conductive set of lines including a second electrically conductive line and a plurality of electrically conductive lines, the second electrically conductive line having a first end connectable to the high voltage generator and a second end connectable to the cathode of the X-ray tube;

means for connecting the cathode of the X-ray tube with a transformer for generating heating current for the cathode via the plurality of electrically conductive lines, each of the plurality of electrically conductive lines including a filter inductor connected in series with the associated of the plurality of electrically conductive lines and the cathode; and means for providing a second terminal resistor connected in series between the second end of the second electrically conductive line and the cathode in parallel with the filter inductor of each of the plurality of electrically conductive lines.

* * * * *